United States Patent [19]

Inoue

[11] Patent Number: 5,025,739

[45] Date of Patent: Jun. 25, 1991

[54] NEEDLE THREAD WIPER OF SEWING MACHINE

[75] Inventor: Tadashi Inoue, Amagasaki, Japan

[73] Assignee: Pegasus Sewing Machine Mfg., Co., Ltd., Osaka, Japan

[21] Appl. No.: 544,601

[22] Filed: Jun. 27, 1990

[30] Foreign Application Priority Data

Jul. 7, 1989 [JP] Japan ..... 1-80664[U]

[51] Int. Cl.[5] ..... D05B 65/00

[52] U.S. Cl. ..... 112/286; 112/253

[58] Field of Search ..... 112/286, 253, 187, 285, 112/297

[56] References Cited

U.S. PATENT DOCUMENTS

| | | | |
|---|---|---|---|
| 2,506,506 | 5/1950 | Ketterer | 112/139 |
| 3,448,708 | 6/1969 | Ross | 112/253 |
| 3,494,316 | 2/1970 | Ross | 112/253 |
| 3,601,074 | 8/1971 | Von Hagen | 112/286 |

FOREIGN PATENT DOCUMENTS

| | | | |
|---|---|---|---|
| 0055286 | 3/1984 | Japan | 112/285 |
| 0071773 | 4/1984 | Japan | 112/285 |

*Primary Examiner*—Werner H. Schroeder
*Assistant Examiner*—Sullivan C. Prak
*Attorney, Agent, or Firm*—Jones, Tullar & Cooper

[57] ABSTRACT

In the needle thread wiper of sewing machine according to the invention, the hook formed at the front end of a leaf spring is projected in or out from the front end of the guide element formed nearly in a J-form, and when inserting this hook into the front end of the guide element, the needle threads extending between the needle and cloth is hooked on the front end of this hook so as to be placed into the front end of the guide element together with the hook. At the front end of the guide element, at the positions corresponding to the both flat surfaces of the leaf spring, notches are formed so as to extend from the front end to the base part side. The needle thread introduced into the front end of the guide element is guided by the notches and placed deeply into the guide element. The needle thread is held merely in a state of being hooked between the hook and the guide element, and so that is easily unhooked, almost without any resistance, when the needle is lowered upon start of next sewing step.

8 Claims, 5 Drawing Sheets

FIG. 3
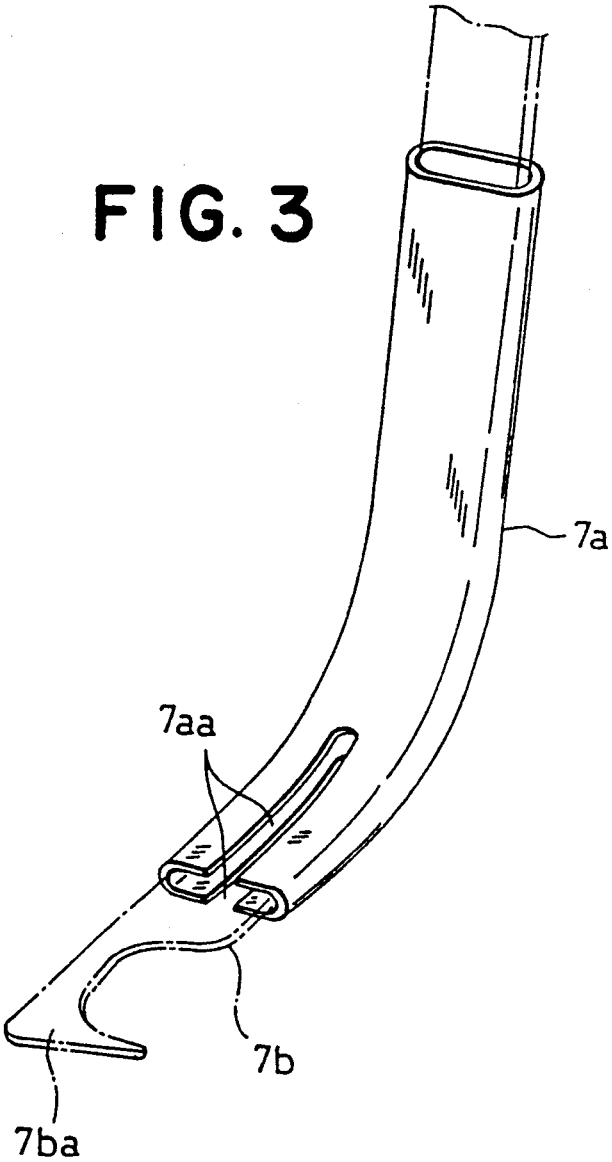
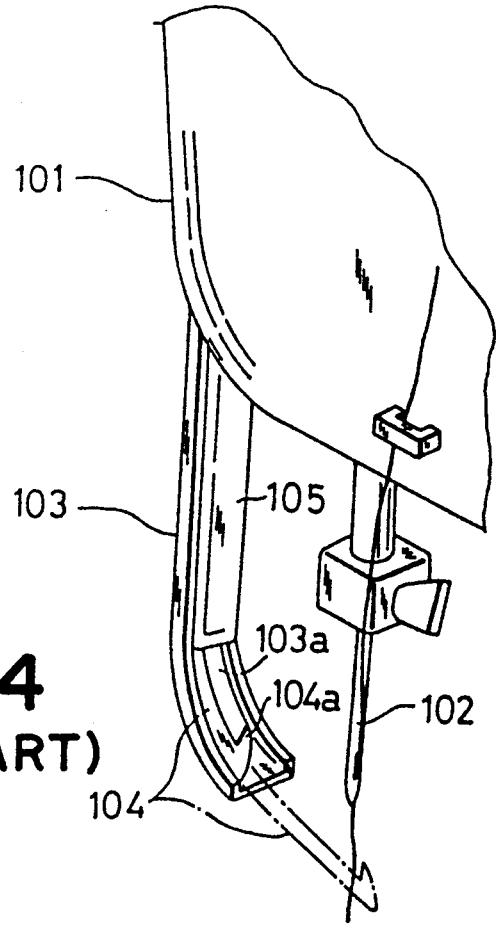
FIG. 4
(PRIOR ART)

NEEDLE THREAD WIPER OF SEWING MACHINE

BACKGROUND OF THE INVENTION

1. Field of the Invention

The invention relates to a needle thread wiper for a sewing machine for retaining the needle thread connected to the needle, which is stopped at the top stopping position, and is cut off from the cloth, so as not to slip off from the tip of the needle.

2. Description of the Prior Art

This type of needle thread wiper for a sewing machine is disclosed, for example, in Japanese Utility Model Publication No. 61-8863. What is disclosed herein comprises, as shown in FIG. 4 herein, a guide 103 having a U-section with its upper end fixed to the side of the arm head of sewing machine 101, and a thread capturing element 104 slidable along the groove 103*c* of the guide 103. In the portion excluding the lower part of the guide 103, a cover 105 for covering the opening of the groove 103*a* is provided. The guide 103 is bent approximately in a J-form so that its lower end may approach the needle thread connected to the needle thread passage between the needle 102 stopped at the top position and the cloth (not shown). The bottom surface of the groove 103*a* forms the guide surface of the thread capturing element 104 communicating with the upper and lower ends of the guide 103. On the other hand, the thread capturing element 104 is formed as a plate extending along the guide surface of the guide groove 103*a*, and at its front end there is a hook 104*a* for capturing the needle thread. Meanwhile, the thread capturing element 104 is flexible so as to press the hook 104*a* to the guide surface of the groove 103*a* at the bent part of the guide 103. This thread capturing element 104 is engaged with the groove 103*a* slidably between the action position of crossing the needle thread passage and the waiting position of having the hook 104*a* pressed to the bottom of the groove 103*a*. That is, when the hook 104*a* at the waiting position is projected along the groove 103*a*, this hook 104*a* moves across the needle thread passage. The thread capturing element 104 is usually held at the waiting position by action means not shown herein, and is also allowed to move to the action position after the needle stops at the top position.

In such a conventional needle thread wiper for a sewing machine, however, the needle thread captured and pulled by the hook 104*a* is held between the guide groove 103*a* and hook 104*a*. Accordingly, if this holding force is strong, the needle may be broken by the tensioning on the thread when next starting the sewing machine. In particular, in multineedle double chain stitch sewing machines or the like for capturing and pulling plural needles by one hook, this holding force was very strong, and the risk of needle breakage was hence very high.

SUMMARY OF THE INVENTION

It is hence a primary object of the invention to provide a needle thread wiper for a sewing machine free from needle breakage when sewing is resumed after capturing the needle thread.

To achieve the above object, the invention provides a needle thread wiper for a sewing machine which comprises:

a guide element fixed on the sewing machine main body and having the front end side formed approximately in a J-form, and a leaf spring slidable on the guide element and having a hook formed at its front end, thereby capturing and pulling the needle thread connected to the needle and cloth by means of the hook of the leaf spring, by sliding the leaf spring along the guide element, the needle thread wiper comprising:

a tube-shaped guide element, a hook as a leaf spring which can be inserted from the J-form front end of the guide element into the guide element, and notches formed at the front end portion of the guide element in the positions corresponding to both flat surfaces of the leaf spring, running from the front end of the guide element to the rear end side of the guide element so that the hook of the leaf could be seen through the notches.

According to such a construction of the needle thread wiper of the sewing machine, by moving the hook formed at the front end of the leaf spring, the needle thread connected to the needle and cloth can be captured and pulled. The pulled needle thread is introduced into the front end of the guide element together with the hook. The needle thread introduced into the front end of the guide element is guided by the notches formed in the guide element to get into the guide element, and is held in a state of being merely hooked on the hook and guide element. The needle thread held in this state is sequentially let out from the hooking portion, almost without resistance, when sewing is resumed and the needle is lowered. Therefore, breakage of the needle by the pulling force of the needle thread is avoided. Moreover, between the preceding stitch and the next stitch formed, the hook may be placed within the guide element, so that damage to the cloth by the hook is avoided.

Thus, in the needle thread wiper for a sewing machine according to the present invention, the leaf spring may be made of a flat wire, and the sliding drive source may be linked to the base part of this leaf spring. Hence, the leaf spring slides smoothly along the guide element.

In the needle thread wiper for a sewing machine of another embodiment of the present invention, by the signal generated when the needle of the sewing machine stops at the top position, the sliding drive source moves the leaf spring to the action position where the hook crosses the needle thread connected to the needle and cloth, and then immediately returns this leaf spring to the waiting position where the hook is set in the guide element. Having such a sliding drive source, the needle thread may be automatically set aside at the same time upon end of the sewing operation.

These effects are particularly outstanding in the case of multineedle double chain stitch sewing machines.

BRIEF DESCRIPTION OF THE DRAWING

FIG. 3 is a perspective view of a guide element, and FIG. 4 is a perspective view of a prior art.

DETAILED DESCRIPTION OF THE PREFERRED EMBODIMENT

Figure 1:
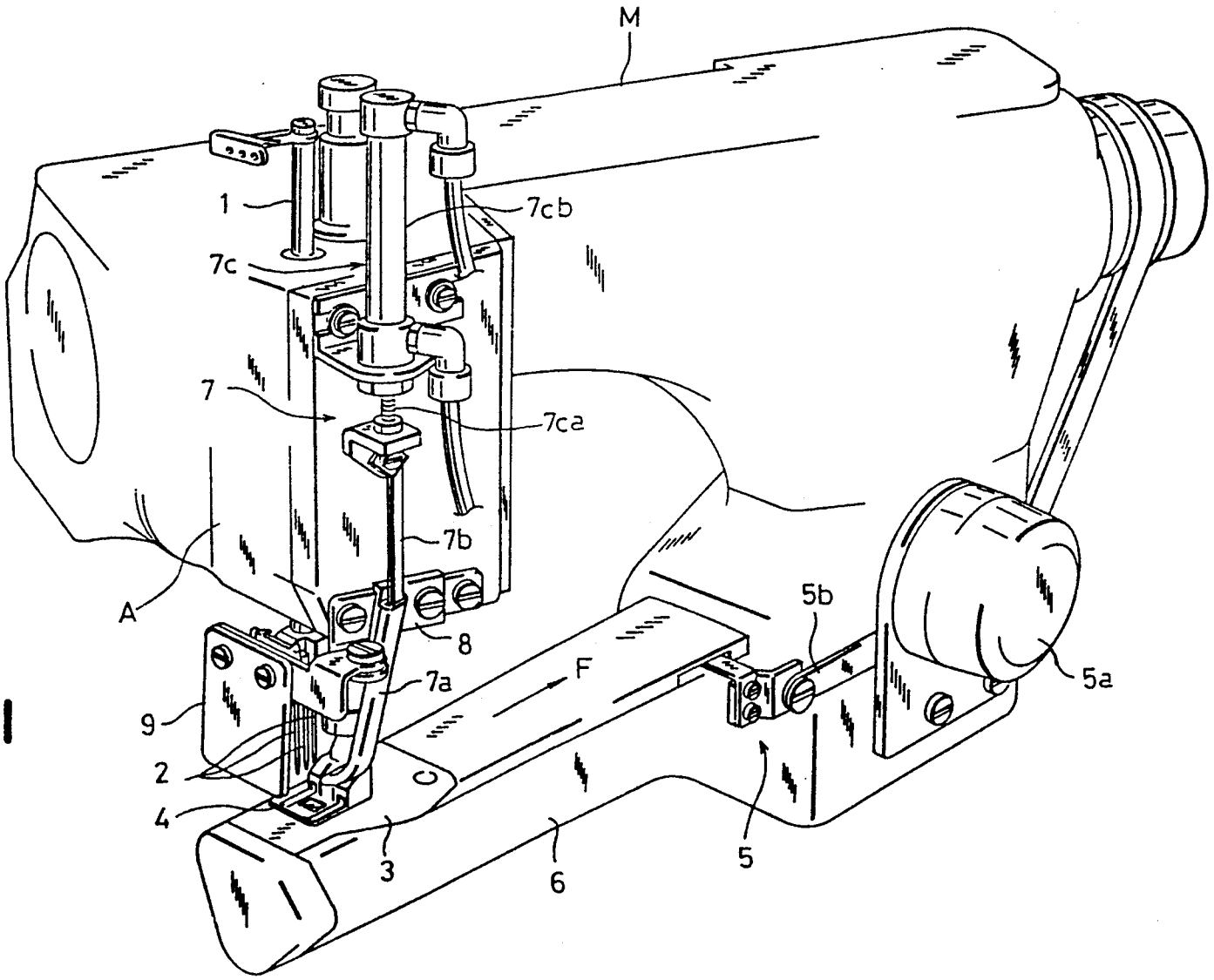
FIG. 1 is a perspective view of a cylinder bed sewing machine having a needle thread wiper.

The cylinder bed sewing machine shown in FIG. 1 comprises a needle bar 1 which penetrates through the main body of the sewing machine M. Fixed at the lower end of this needle bar 1 there are three needles 2 arranged in a direction orthogonal to the cloth feed direction (arrow F). The needle bar 1 is supported so as to be movable vertically to the sewing machine main body M, and it moves up and down in cooperation with the main shaft of the sewing machine (not shown). The drive mechanism for moving the needle bar 1 up and down can stop the needles 2 at the top position above the throat plate 3 by known home position stopping means. Corresponding to the needles 2 there is provided an elevatable presser foot 4 for holding the cloth together with the throat plate 3.

The sewing machine main body M is furnished with a known thread cutter 5 which cuts the needle thread connected to the needles 2 beneath the throat plate 3. In FIG. 1, however, only the solenoid 5*a* which is the drive source of this thread cutter 5 installed at the front side of the sewing machine main body M and the lever 5*b* for transmitting the driving force of the solenoid 5*a* are shown, and the cutter disposed in the bed 6 and linked to the lever 5*b* is not shown.

The needle thread wiper 7 of the invention is installed at the front side of the arm head A of the sewing machine main body M. This needle thread wiper 7 comprises a guide element 7*a*, a leaf spring 7*b*, and an air cylinder 7*c*.

Figure 2A:
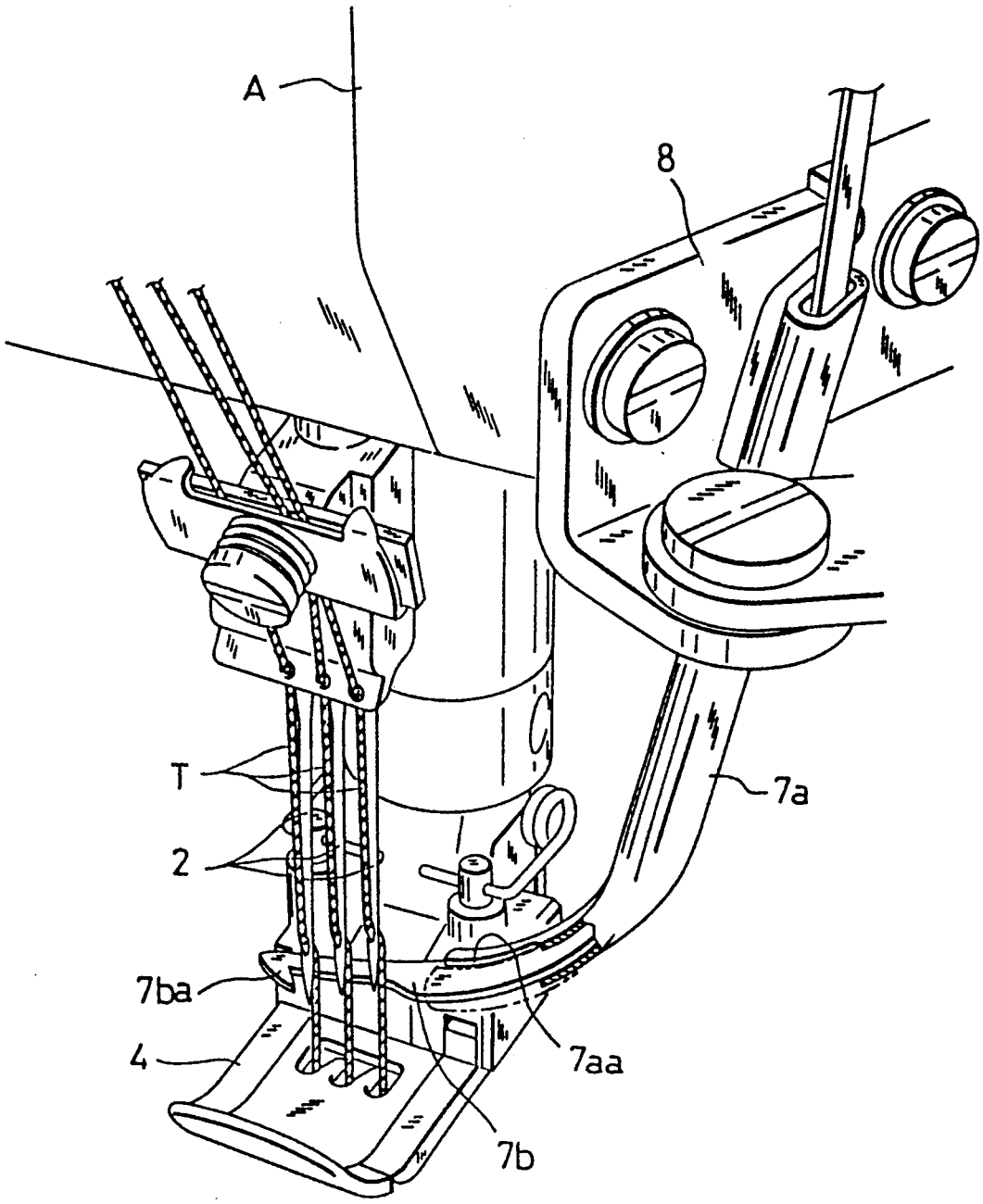
FIG. 2A is a partially cut-away perspective view of essential parts showing one stage of the action state of the needle thread wiper.
Figure 2B:
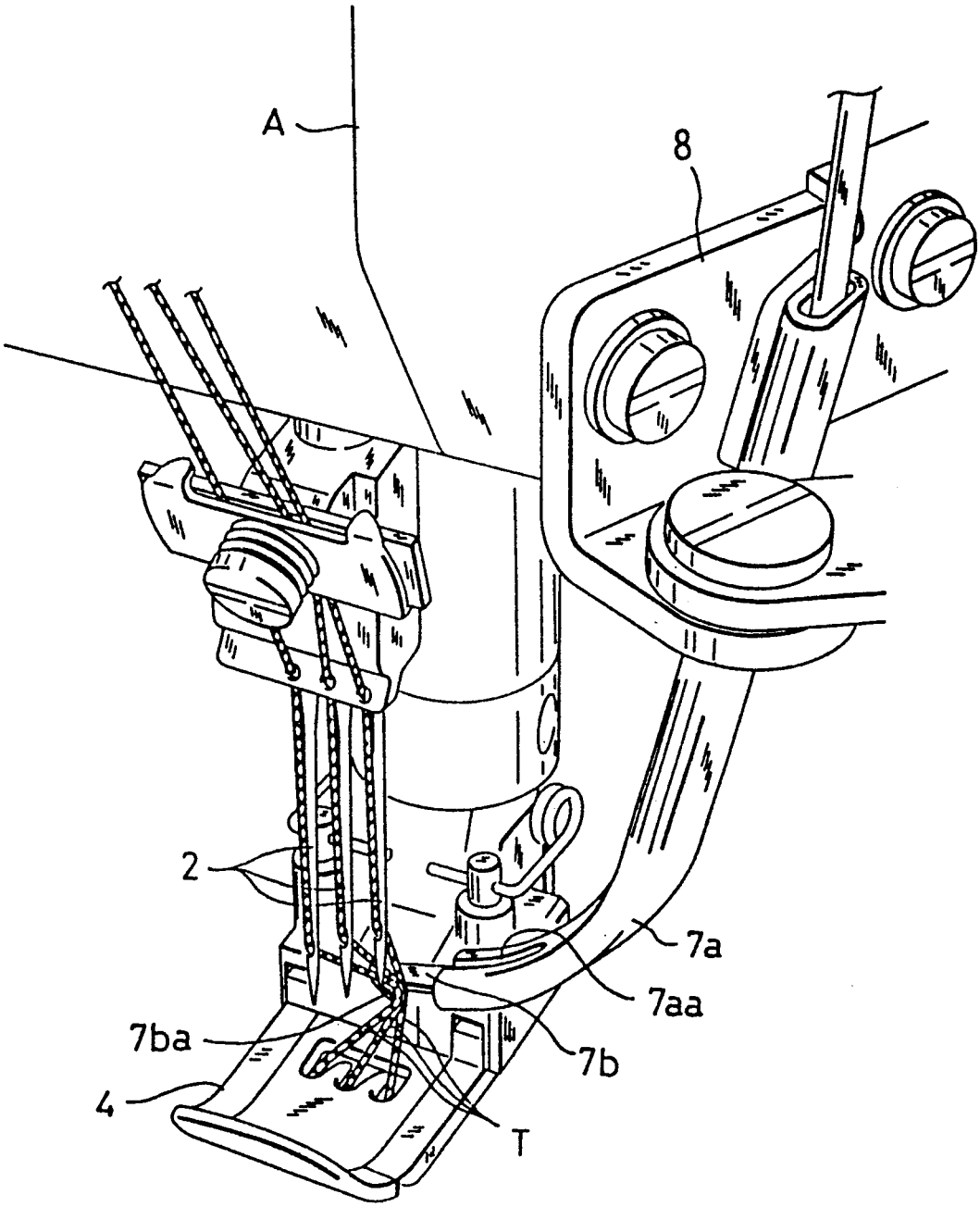
FIG. 2B is a perspective view of essential parts showing another stage of the action state of the needle thread wiper.
Figure 2C:
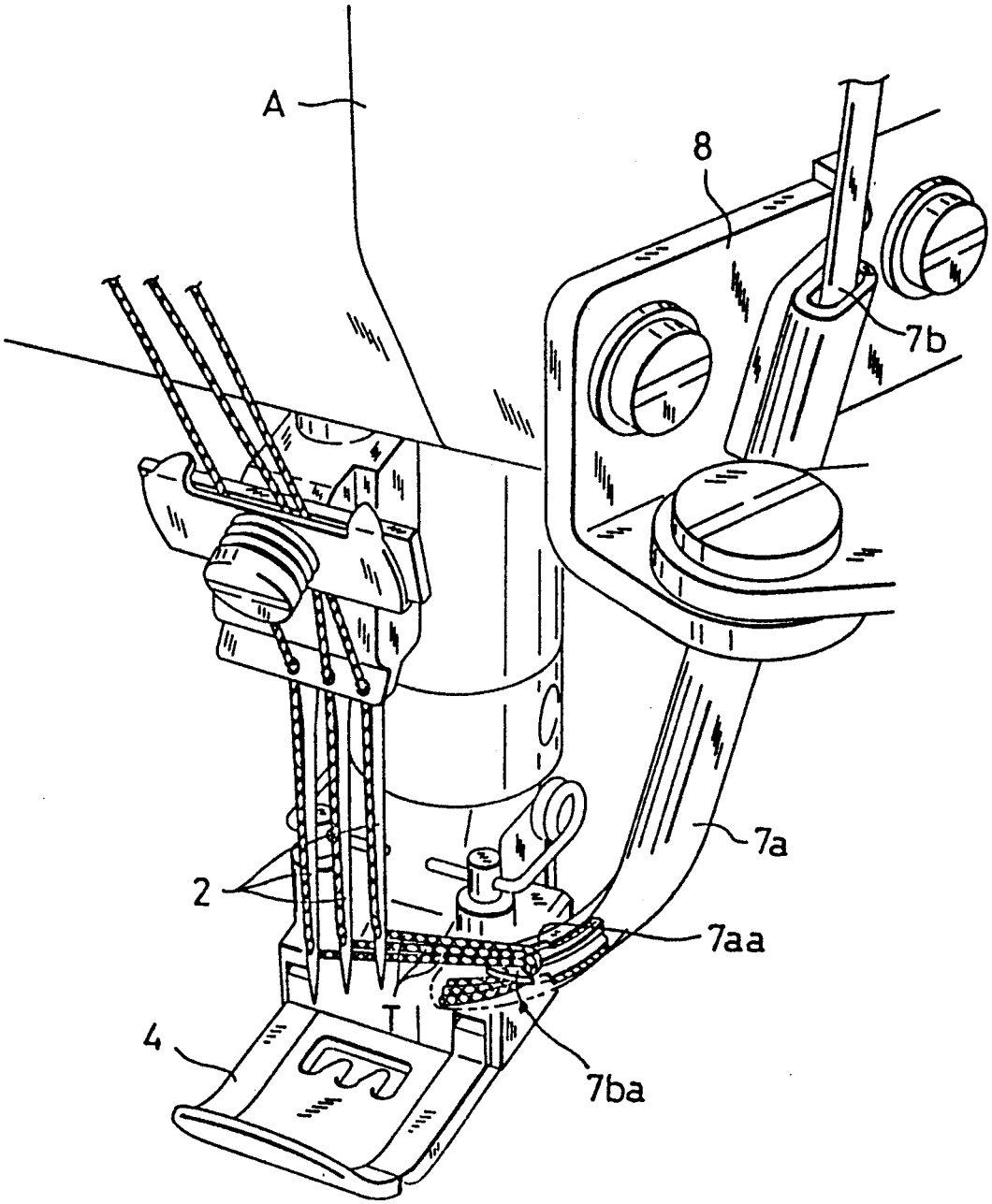
FIG. 2C is a partially cut-away perspective view of essential parts showing another stage of the action state of the needle thread wiper.

The guide element 7*a* is in a tube form, of which the lower end side is bent in a J-form and is opened. As shown in FIGS. 2A to 2C, the upper end side of the guide element 7*a* is fixed to a bracket 8 mounted on the arm head A. The open lower end of the guide element 7*a* is positioned at a confronting position between the front ends of the needles 2 stopped at the top position above the throat plate 3 and the presser foot 4. As clearly shown in FIG. 3, at the lower end of the guide element 7*a* bent in a J-form, notches 7*aa* running from the lower end toward the upper end are formed in the upper and lower surfaces corresponding to both flat surfaces of the leaf spring 7*b* inserted therein. By the existence of the notches 7*aa*, the end of the guide element 7*a* is bifurcated.

The leaf spring 7*b* is a flat wire rod slidably inserted into the guide element 7*a*. A hook 7*ba* is formed at the front end of this leaf spring 7*b*. Meanwhile, as shown in FIG. 1, the base part of the leaf spring 7*b* is projected from the upper end of the guide element 7*a*, and it is here linked with the piston rod 7*ca* of the air cylinder 7*c*. The hook 7*ba* is formed in a shape so as to be able to be completely retracted from the lower end opening of the guide element 7*a*. The leaf spring 7*b* is slidably supported on the guide element 7*a*. Or, as shown in FIG. 2A; in the state where the needle threads T are continuously extended between the lower end of the needles 2 stopped at the top position and the cloth (not shown), when the leaf spring 7*b* slides in the direction of projecting from the lower end of the guide element 7*a*, the hook 7*ba* crosses the needle threads T. Afterwards, the hood 7*ba* hooks the needle threads T so that they can be gathered at the lower end side of the guide element 7*a* when the hook 7*ba* slides back to the base part through the guide element 7*a*.

The air cylinder 7*c* serves as the drive source for sliding the leaf spring 7*b*. The air cylinder 7*c* has its cylinder mainbody 7*cb* fixed at the front side of the arm head A, and the leaf spring 7*b* linked to the piston rod 7*ca* is held usually in a state that the hook 7*ba* is withdrawn in the guide element 7*a*. When the piston rod 7*ca* is projected by sending air into the cylinder main body 7*cb* of this air cylinder 7*c*, the leaf spring 7*b* slides along the guide element 7*a*, so that the hook 7*ba* at the front end of leaf spring 7*b* is projected from the front end of the guide element 7*a*.

Besides, as shown in FIG. 1, in front of the needles 2, an eye guard 9 attached to the sewing machine main body M is installed to protect the operator from broken and scattered needles.

The operation of the needle thread wiper constructed as noted above in a cylinder bed sewing machine is described below.

First, as stated above, usually when forming stitches, this needle thread wiper 7 is held in a state where the hook 7*ba* of the leaf spring 7*b* is withdrawn in the guide element 7*a* by means of the air cylinder 7*c*.

Next, upon completion of forming a stitch, when the needles 2 stop at the top position, a signal is received and air is sent into the cylinder main body 7*cb* of the air cylinder 7*c*. As a result, the piston rod 7*ca* is extended, and the leaf spring 7*b* slides along the guide element 7*a*, so that the hook 7*ba* of the leaf spring 7*b* is also extended while entangling the needle threads T between the lower end of the needles 2 . . . and the presser foot 4.

In this way, as showing FIG. 2A, the hook 7*ba* extends to the predetermined position, that is, in the case of the illustrated embodiment, to the position of crossing the needle thread T engaged with the needles 2 at the remotest position from the lower end of the guide element 7*a*. When the hook 7*ba* reaches this specified position, supply of air into the cylinder main body 7*cb* is stopped, and then air is sucked from this cylinder main body 7*c*. As a consequence, the leaf spring 7*b* is retracted to the air cylinder 7*c* side, and the hook 7*ba* once projecting from the guide element 7*a* is drawn again into the guide element 7*a*. Along with this withdrawal, as shown in FIG. 2B, the hook 7*ba* captures the three needle threads T, and pulls them to the front end side of the guide elements 7*a*. Meanwhile the towed needle threads T are simultaneously cut off and separated from the cloth by the thread cutter 5 beneath the throat plate 3.

By continuing to suck air from the cylinder main body 7*cb* even after the needle threads T are separated from the cloth, the hook 7*ba* is drawn into the guide element 7*a*. Along with this, the needle threads T are led into the guide element 7*a* while being guided along the notches 7*aa* formed at the front end of the guide element 7*a* as shown in FIG. 2C. In this way, the needle threads T cut off from the cloth are hooked between the hook 7*ba* and the guide element 7*a*, and are held so as not to slip out from the front end of the guide element 7*a*.

Next, to form the next stitch in this state, the needles 2 are lowered, and at this time, since the needle threads T are merely hooked between the hook 7*ba* and the guide element 7*a*, the needle threads T are sequentially let out from the hooked portions. Therefore, when lowering the needles 2, the needles 2 . . . are not pulled by the needle threads T, and breakage of the needles 2 . . . upon starting of the formation of the next stitch is prevented. Besides, since the hook *7ba* remains within the front end of the guide element *7a* before start of the next stitch, damage to the cloth by hooking is avoided.

The foregoing embodiment relates to a three-needle sewing machine, but the invention may be applied, needless to say, regardless of the number of needles of the sewing machine. Yet the mechanism for sliding the leaf spring is not limited to the mechanism of using an air cylinder as disclosed in the embodiment, but other mechanism using solenoid or other driving means may be also employed as well.

What is claimed is:

1. A needle thread wiper for a sewing machine having a main body and at least one needle, said needle thread wiper comprising:

a tube-shaped guide element fixed on the sewing machine main body, said guide element having spaced apart flat surfaces and a front end portion formed approximately in a J-form, said front end portion including a notch formed in each of the flat surfaces; and a leaf spring having flat surfaces and a front end having a hook formed therein, said leaf spring being slidable within the guide element, said hook serving to capture and pull the needle thread extending from each needle by sliding the leaf spring in the guide element, wherein the notches are formed in each flat surface of the guide element extending along the guide element away from said front end portion so that the hook of the leaf spring can be seen through the notches.

2. The needle thread wiper for a sewing machine as defined in claim 1, further comprising:

a drive source wherein the leaf spring is made of flat wire and further has a base part spaced from said front end portion, said drive source being connected to said base part for producing the sliding movement of said leaf spring.

3. The needle thread wiper for a sewing machine as defined in claim 2, wherein the drive source is an air cylinder.

4. The needle thread wiper for a sewing machine as defined in claim 2, wherein the drive source moves the leaf spring to a thread catching position wherein the hook crosses the needle thread in response to a signal generated when the needle stops at a top position, and then immediately returns the leaf spring to a waiting position in which the hook is set in the guide element.

5. The needle thread wiper for a sewing machine as defined in claim 1, wherein the sewing machine is a multineedle double chain stitch sewing machine.

6. The needle thread wiper for a sewing machine as defined in claim 2, wherein the sewing machine is a multineedle double chain stitch sewing machine.

7. The needle thread wiper for a sewing machine as defined in claim 3, wherein the sewing machine is a multineedle double chain stitch sewing machine.

8. The needle thread wiper for a sewing machine as defined in claim 4, wherein the sewing machine is a multineedle double chain stitch sewing machine.

* * * * *

UNITED STATES PATENT AND TRADEMARK OFFICE

CERTIFICATE OF CORRECTION

PATENT NO. : 5,025,739

DATED : June 25, 1991

INVENTOR(S) : Tadashi INOUE

It is certified that error appears in the above-identified patent and that said Letters Patent is hereby corrected as shown below:

Claim 4, column 6, line 15, "wherein" should be "where".

Signed and Sealed this

Thirteenth Day of October, 1992

*Attest:*

DOUGLAS B. COMER

*Attesting Officer*

*Acting Commissioner of Patents and Trademarks*